US010059511B2

(12) United States Patent
Kleis et al.

(10) Patent No.: US 10,059,511 B2
(45) Date of Patent: Aug. 28, 2018

(54) CARGO CONTAINER DOOR CLOSURE MECHANISM

(71) Applicant: Driessen Aerospace Group N.V., Alkmaar (NL)

(72) Inventors: Reinier Kleis, Middenmeer (NL); Kees Portegies, Nieuwe-Niedorp (NL)

(73) Assignee: Driessen Aerospace Group N.V., Toermalijnstraat (NL)

( * ) Notice: Subject to any disclaimer, the term of this patent is extended or adjusted under 35 U.S.C. 154(b) by 176 days.

(21) Appl. No.: 15/245,478

(22) Filed: Aug. 24, 2016

(65) Prior Publication Data

US 2017/0057738 A1 Mar. 2, 2017

Related U.S. Application Data

(60) Provisional application No. 62/211,571, filed on Aug. 28, 2015.

(51) Int. Cl.

| | |
|---|---|
| ***B65D 90/54*** | (2006.01) |
| ***B65D 90/00*** | (2006.01) |
| ***B65D 88/14*** | (2006.01) |
| ***B65D 90/02*** | (2006.01) |

(52) U.S. Cl.

CPC ..... *B65D 90/008* (2013.01); *B65D 88/14* (2013.01); *B65D 90/021* (2013.01)

(58) Field of Classification Search

CPC ..... B65D 90/008; B65D 90/021; B65D 88/14

USPC ..... 220/1.5; 160/368.1

See application file for complete search history.

(56) References Cited

U.S. PATENT DOCUMENTS

| | | | | |
|---|---|---|---|---|
| 4,046,186 | A | 9/1977 | Nordstrom | |
| 5,667,002 | A * | 9/1997 | Neustadt | B65D 88/14 160/368.1 |
| 2007/0056967 | A1 | 3/2007 | Dobrinski et al. | |

FOREIGN PATENT DOCUMENTS

| | | |
|---|---|---|
| DE | 19953615 | 5/2001 |
| WO | 2013106640 | 7/2013 |

OTHER PUBLICATIONS

International Patent Application No. PCT/IB2016/055051, Search Report and Written Opinion, dated Nov. 9, 2016.

* cited by examiner

*Primary Examiner* — Stephen Castellano
(74) *Attorney, Agent, or Firm* — Kilpatrick Townsend & Stockton LLP; Dean W. Russell; Kristin M. Crall

(57) ABSTRACT

Embodiments of the invention described herein thus provide systems and methods for improved securement of a cargo cover/flexible door to a cargo container. The systems generally provide securement using cooperating frame securement features positioned on the cargo container and securement plates positioned on door straps of the cargo cover.

26 Claims, 8 Drawing Sheets

CARGO CONTAINER DOOR CLOSURE MECHANISM

CROSS REFERENCE TO RELATED APPLICATIONS

This application claims the benefit of U.S. Provisional Application Ser. No. 62/211,571, filed Aug. 28, 2015, titled "Mushroom ULD Door Mechanism," the entire contents of which are hereby incorporated by reference.

FIELD OF THE DISCLOSURE

Embodiments of the present disclosure relate generally to cargo containers and closure systems for cargo containers.

BACKGROUND

Cargo containers are used on-board transportation vehicles for containing and moving cargo. Air cargo containers may be used to transport cargo or baggage or other items on aircraft. Such air cargo containers generally must be certified for airworthiness and safety for their use as transport boxes within aircraft. Cargo containers may be used on-board passenger transport aircraft, such as in the cargo bay below the main deck. Cargo containers may also be used on-board cargo aircraft, which generally carry cargo on two levels, the lower deck and the main deck. Different cargo containers may have varying shapes and contours for their outer profile and door openings, depending upon whether designed for use on the lower or main deck.

Cargo containers are typically closed using a flexible cover and a door net. A flexible cover, such as a tarpaulin, covers the opening of the cargo container to protect the container contents against weather elements, such as rain, wind, and snow. The cover can also be secured in place via a door net that is fixed to the container frame. A door net can be positioned in front of the flexible cover in order to provide structural integrity and to restrain the contents within the container. The combination of the cover and net allow the container to pass certification strength testing. In order to secure the cover and net to the frame, traditional cargo containers have been provided with an external hook system, illustrated by FIGS. 13 and 14.

As shown, the hook system 2 generally includes a hook 4 on an end of a door net strap 3, and a bracket 5 that is fixed to the cargo container. Once the cover is in place over the cargo container opening, the loading crew secures the hook 4 to the bracket 5. The hook 4 has a curved finger element that can loop over and be secured with respect to the bracket 5.

However, the hooks 4 and brackets 5 are vulnerable to impact during handling. For example, forklift movements or container positioning movements can cause deformation of the hook and/or the bracket. The hook 4 may be bent to prevent its correct cooperation with the bracket. The bracket 5 may be compressed or otherwise deformed in a way that prevents sufficient clearance for the hook 4 to secure thereto. A non-usable hook 4 or bracket 5 can render the cargo container unusable because it may no longer comply with certification requirements.

Other solutions to replacing the hook and bracket system have been to use hook and loop material, such as Velcro®, for securing the cargo cover in place. However, such securement is not entirely secure and reliable. Accordingly, improvements to cargo container cover systems are desirable.

BRIEF SUMMARY

Embodiments of the invention described herein thus provide systems and methods for improved securement of a cargo cover/flexible door to a cargo container. The systems generally provide securement using cooperating frame securement features positioned on the cargo container and securement plates positioned on door straps of the cargo cover. The systems described have also been found to provide better protection to the cargo contents from external elements, such as rain, snow, wind, and so forth. They can tighten the flexible door in a way that can reduce gaps or openings that could otherwise allow environmental elements to dame the cargo contained therein. The attachment method described can help restrict movement of the flexible cover/door when secured/affixed to the container frame.

In one example, there is provided a cargo container closure system, comprising: a cargo cover for closing an opening of a cargo container, the cargo cover comprising a plurality of securement plates secured thereto, each securement plate comprising a head and a stem; a corresponding number of frame securement features secured to the cargo container, each frame securement feature comprising a head-receiving portion for receiving the head and an elongated portion for receiving the stem.

At least one frame securement feature may have a first orientation and at least a second frame securement feature may have a second orientation. In one example, upper frame securement features are positioned in the first orientation and a lowermost frame securement feature is positioned in the second orientation. Additionally or alternatively, the frame securement features are installed on the cargo cover at an angle.

Each securement plate may be secured to a strap positioning the securement plate on the cargo cover. There may be a plurality of cargo door straps secured to the cargo cover, the plurality of cargo door straps comprising the plurality of securement plates. At least one of the door straps may comprise a sizing feature, such as a cam buckle. The cam buckle door strap may be at an upper part of the cargo cover, at a lower part of the cargo cover, or both.

The securement plates may also have a release handle for removing the securement plate with respect to each frame securement feature. In other examples, each securement plate comprises at least one through hole for receiving a security seal. The through holes may be symmetrical through holes at opposite edges of the securement plate. This allows the plate to be used on either side of the container.

The cargo door cover may have a composite sheet at its lower portion.

In a specific example, there is provided a cargo container closure system, comprising: a cargo cover for closing an opening of a cargo container, the cargo cover comprising a plurality of securement plates secured thereto, each securement plate comprising a head; a stem; two strap attachment openings configured to be secured to a door strap of the cargo cover and a release handle; and at least one through hole; a corresponding number of frame securement features secured to the cargo container, each frame securement feature comprising a head-receiving portion for receiving the head and an elongated portion for receiving the stem, wherein at least one frame securement feature has a first orientation and at least a second frame securement feature has a second orientation.

A method for securing this cargo container closure system may be securing the head of each first securement plate with respect to a head-receiving portion of each frame securement feature; applying pressure to close the cargo cover against the cargo container. A security seal may be applied through the at least one through hole of the securement plate and securing the seal to a ring on the cargo container.

DETAILED DESCRIPTION

Figure 1:
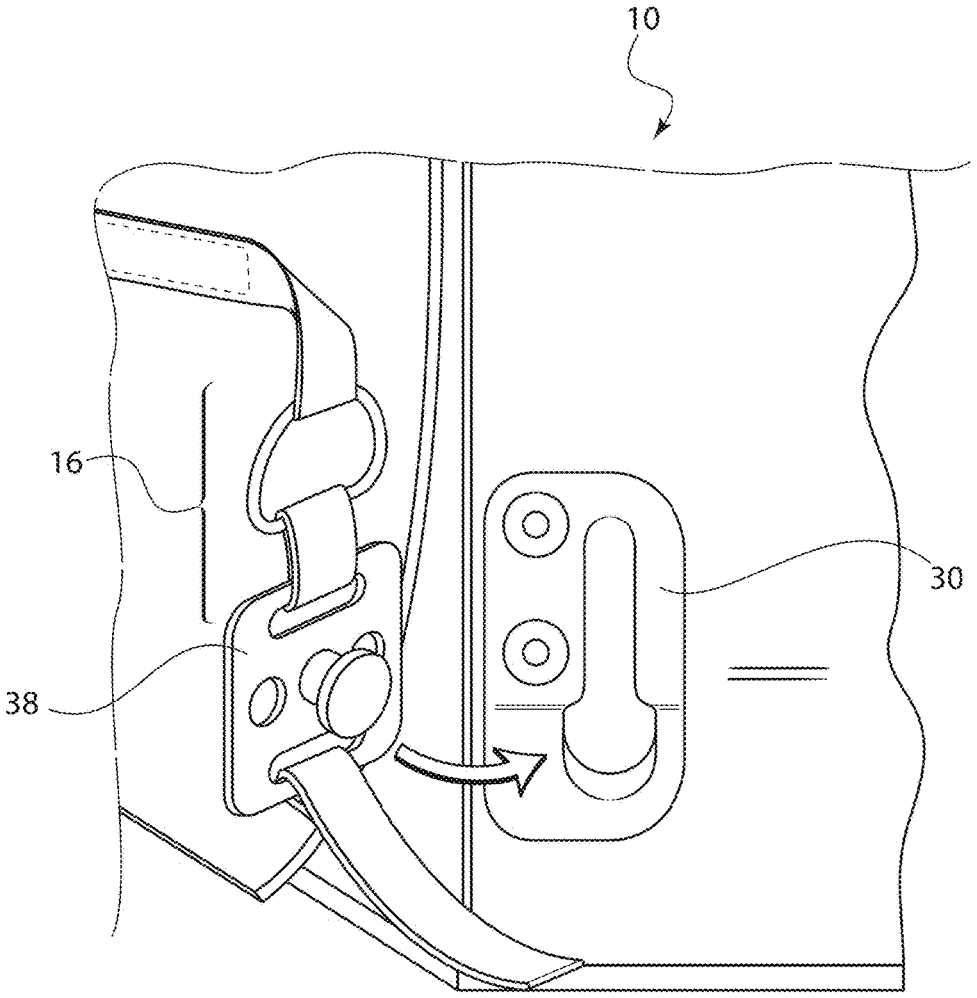
FIG. 1 shows a side perspective view of one example of a cargo container closure system.
Figure 2:
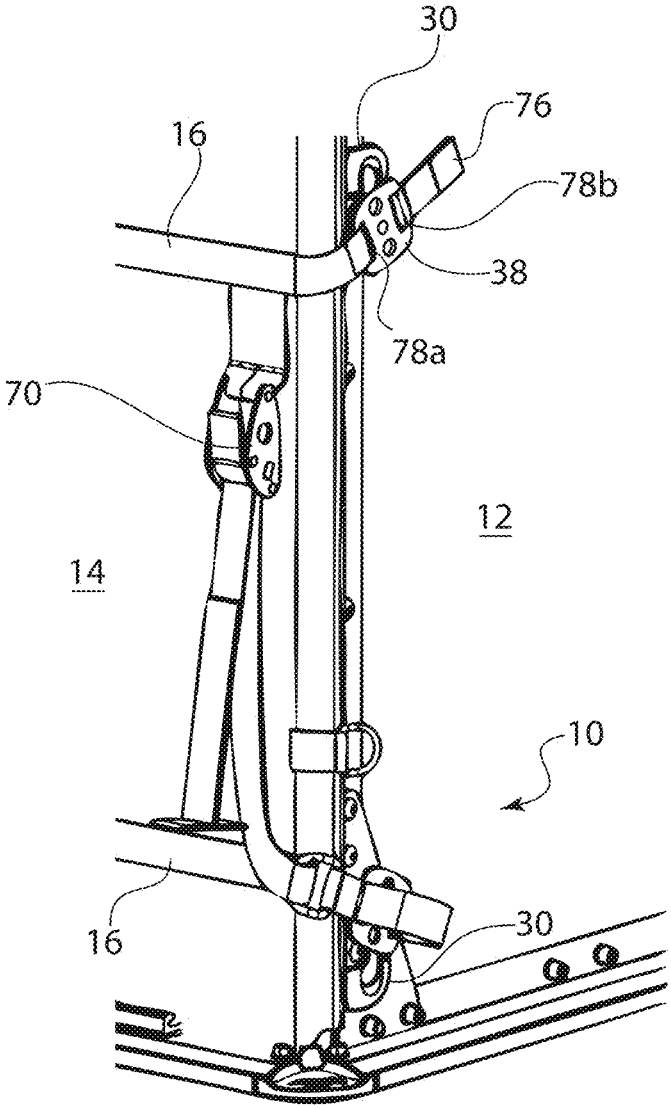
FIG. 2 shows a side perspective view of a cargo cover closed using the system of FIG. 1, with lower tightening cam brackets.

The present disclosure provides a system 10 that allows a cargo container 12 to be covered and to have its contents secured without presenting many of these potential damage situations and/or and challenges. As shown by FIGS. 1 and 2, the system 10 provides a cargo cover 14 with a plurality of straps 16 secured thereto. The cargo cover 14 is generally manufactured out of canvas or a canvas-like material. The straps 16 may be stitched to the cover 14, heat bonded to the cover 14, or otherwise secured thereto. In this manner, the cover 14 is provided as a single component, with the straps 16 integrally formed therewith. (There is not a separate cover net required for securement.) The straps 16 may be provided with one or more sizing features to expand and tighten the straps 16 once they are positioned. In one example, the sizing features may be cam buckles 70. (The cam buckles used may be industry standard buckles; they tension the straps 16 with respect to the cargo container 12 once the cargo cover 14 has been positioned.)

Figure 3:
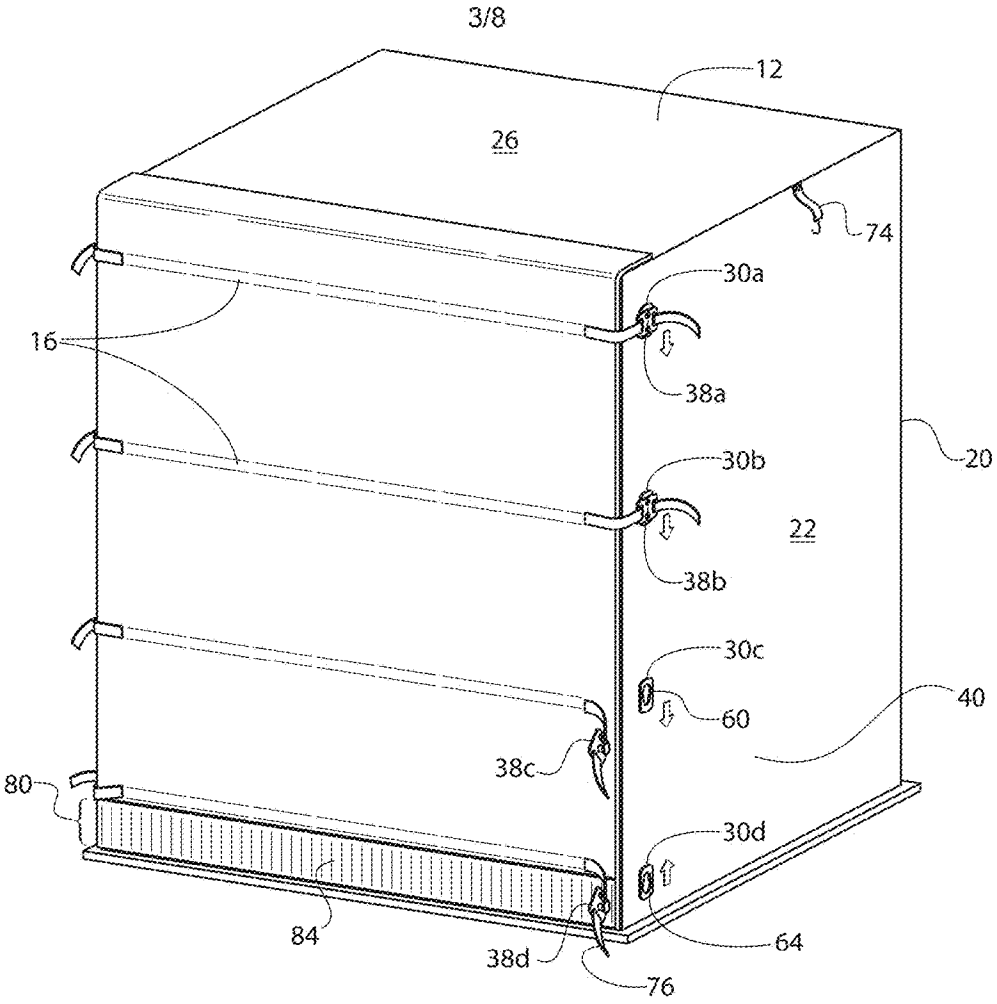
FIG. 3 shows a front perspective view of a cargo container closed using the system of FIG. 1
Figure 4:
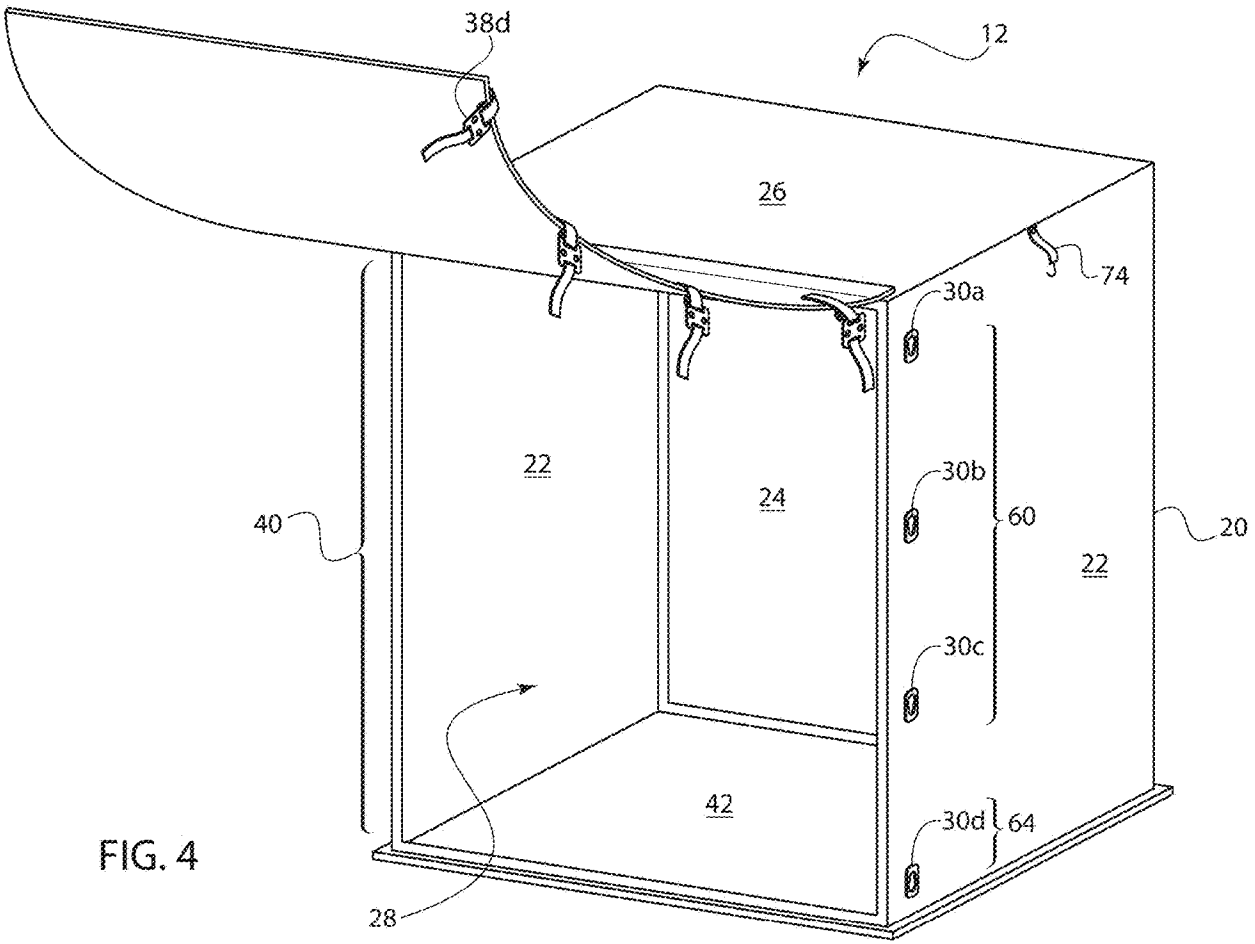
FIG. 4 shows a front perspective view of a cargo container with a cargo cover open.
Figure 5A:
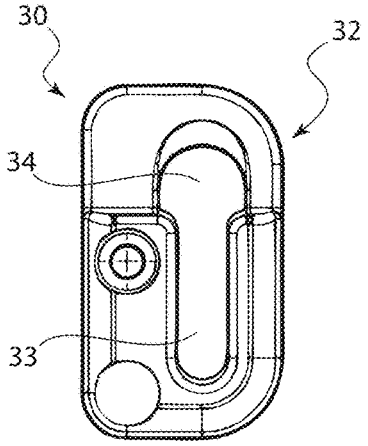
FIG. 5A shows a top plan view of one example of a frame securement feature, in the shape of a D-slot.
Figure 5B:
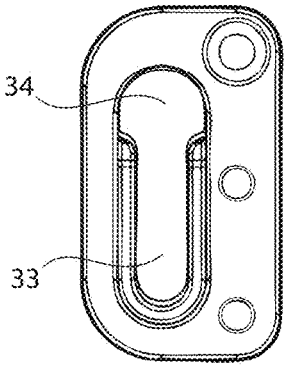
FIG. 5B shows a rear plan view of the frame securement feature of FIG. 5A.
Figure 6:
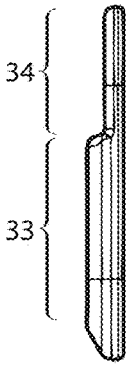
FIG. 6 shows a side plan view of the frame securement feature of FIG. 5A.
Figure 7:
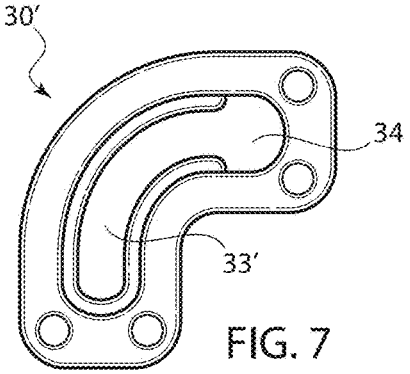
FIG. 7 shows a top plan view of an alternate embodiment of a frame securement feature.

The cargo container 12 generally has an outer frame 20. The frame 20 is defined by side walls 22, a back wall 24, a ceiling 26, and a cargo opening 28. In use, the cargo cover 14 covers the opening 28, as shown by FIGS. 3 and 4. Along the front portions 40 of the side walls, nearest the opening 28, are provided one or more frame securement features 30. As illustrated by FIGS. 5-6, the frame securement features 30 may generally be shaped as D-shaped slots 32. The D-shaped slots 32 are provided with an elongated portion 33 and a head-receiving portion 34. The elongated portion 33 may be shaped as a slot or channel in the securement feature. The head-receiving portion 34 is sized and shaped to receive a corresponding head 36 on securement plate 38, described in more detail below. The frame securement feature 30 may be provided as having a different configuration. As illustrated by FIG. 7, the feature 30' may have an L-shaped configuration, such that the head-receiving portion 34 is angled from the elongated portion 33'. For example. The head-receiving portion 34 and the elongated portion 33' are not aligned along the same axis. In this example, it is possible for the elongated portion 33' to have a curvature that allows the stem 46 of the securement plate 38 to slide therein. As described further below, the frame securement features 30 may be secured to the container frame 20 is any desired configuration or orientation.

As illustrated by FIGS. 3 and 4, a plurality of D-shaped slots 32 function as frame securement features 30 and are positioned along the side walls 22, at locations where the cargo cover 14 will be secured to the cargo container 12. In the examples illustrated, there are four features 30 positioned along front portions 40 of each sidewall 22. Three of the features 30 are positioned midway along the sidewall 22, and a fourth features 30 is positioned along a base 42 of the sidewall 22. The upper three features 30 are shown having a first orientation 60 and the lower features 30 is shown having a second orientation 64. Reasons for this orientation and securing methods are described further below.

Figure 8:
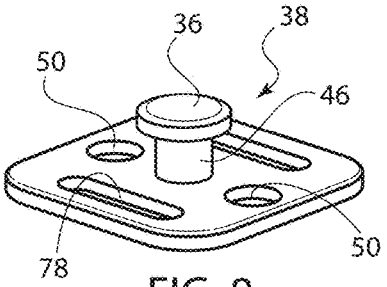
FIG. 8 shows a side perspective view of one example of a securement plate.
Figure 9:
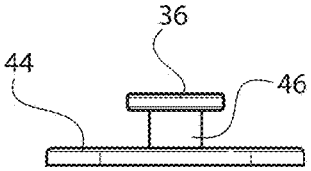
FIG. 9 shows a side plan view of the securement plate of FIG. 8.
Figure 10:
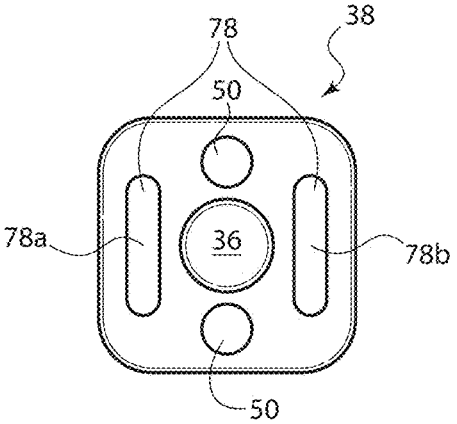
FIG. 10 shows a top plan view of the securement plate of FIG. 8.

FIGS. 8-10 illustrate one example of a securement plate 38. As shown, securement plate 38 has a first face 44 that supports a stem 46 and a head 36. The side view of the stem 46 and head 36 resemble a mushroom-like shape. Head 36 is illustrated as generally having a circular shape. In another example, the head may have a ball-like or spherical shape. Other shapes are also possible. The shape of head 36 should generally correspond to the shape of the head receiving portion 34 of the D-shaped slot 32. For example, if the portion 34 is oval, the head 36 may be oval. If the portion 34 is square, the head 36 may be square. Other options are possible.

The securement plate 38 also has straps attachment opening 78 openings. In the examples shown, one strap attachment opening 78*a* is secured to a cargo door strap 16. An opposite strap attachment opening 78*b* is secured to a release handle 76. The release handles 76 are designed to be long enough for a user to grasp the handle in order to manipulate the securement plate 38, but not so long that they hang or drag on the floor. This is particularly desirably the case for the release handle 76 positioned on the lowermost securement plate.

In use, the head 36 of the securement plate 38 is positioned into the head-receiving portion 34 of the frame securement feature 30 (which is illustrated in the figures as a D-slot 32). The head 36 is sized to be just slightly smaller than the head-receiving portion 34 such that head 36 may be inserted therethrough. The securement plate 38 is then moved so that stem 46 engages the elongated portion 33 and the head 36 moves away from the head-receiving portion 34, behind the elongated slot. This movement creates a secure connection between the securement plate 38 and the frame securement feature 30.

As illustrated by FIG. 4, at least one frame securement feature 30 is positioned in a first orientation 60. This orientation 60 generally provides the head-receiving portion 34 positioned closer to the ceiling 26 of the cargo container 12 and the elongated portion 33 is positioner closer to the base 42 of the cargo container 12. FIG. 4 illustrates the upper three frame securement features 30*a*-30*c* as having this first orientation 60. Additionally, at least one frame securement feature 30 is also positioned in a second orientation 64. This second orientation 64 generally provides the head-receiving portion 34 positioned closer to the base 42 of the cargo container 12 and the elongated portion 33 positioner closer to the ceiling 26 of the cargo container 12. FIG. 4 illustrates the lowermost frame securement feature 30*d* as having this second orientation 64.

It should be understood, however, that the orientations 60, 64 of the frame securement features 30 may be reversed. For example, the head-receiving portions 34 of the upper features 30 may face the container base 42. The head-receiving portion 34 of the lower feature 30 may face the container ceiling 26. In another example, the frame securement features 30 may be provided at an angle. For example, the head-receiving portions 34 may face an upper corner or lower corner of the container. In another example, the head-receiving portions 34 may face the rear wall of the container, such that the features 30 are about 90° from the orientation shown in FIG. 4. In a further example, the head-receiving portions 24 may face the opening 28 of the container, such that the features 30 are about 90° in the other direction from the orientation shown in FIG. 4. In a further example, curved features 30' of FIG. 7 may be used and secured to the frame at any angle.

In order to close the cargo cover 14 over the cargo opening 28, the upper securement plates 38 are positioned with respect to the upper frame securement features 30. If the upper securement plates are positioned in the first orientation 60, the head 36 of the securement plate 38 is positioned in the head-receiving portion 34 of a corresponding frame securement feature 30. The release handle 76 to which the securement plate 38 is attached is pulled down in order to lodge the head 36 into the head-receiving portion 34. This downward pull is illustrated by the downward arrows in FIG. 3. This is repeated for all but the lowermost securement plate 38*d*. If the lower most feature 30*d* is in an opposite orientation, the head 36 of the securement plate 38*d* is positioned in the head-receiving portion 34 of the corresponding lowermost frame securement feature 30*d*. The release handle 76 to which the securement plate 38 is attached is pulled up in order to lodge the head 36 into the head-receiving portion 34. This upward pull is illustrated by the upward arrow in FIG. 3. Once all plates are secured, cam buckles 70 on the straps 16 are tensioned in order to pull the upper plates 38*a-c* down and to pull the lowermost plate 38*d* up. This helps ensure a secure closure of the cargo door 14.

If the frame securement features 30 or the cam buckles are provided at different orientations, the securement may take a different pattern. For example, if the cam buckles 70 and their corresponding straps for tightening the cover in place are positioned along an upper portion of the cargo door cover (rather than at the lower portion shown), the tightening process may be reversed. Additionally or alternatively, if the features 30 are installed at an angle or if curved features are used, then release handles 76 may be pulled rearwardly, forward, or otherwise at angles necessary to position the head 36 of the securement plate 38 into the head-receiving portion 34 of the feature 30, and then urge the stem 46 to travel in the elongated portion 33 in order to lodge the head 36 in place.

Figure 11:
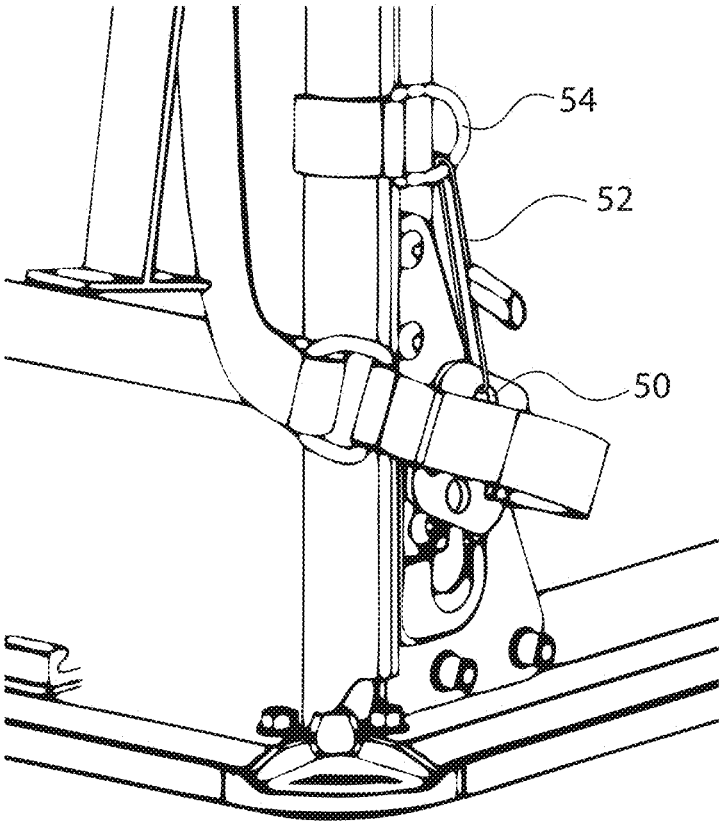
FIG. 11 shows a side perspective view of a securing seal, of the type used by customs, securing a cargo closure system from tampering.

Through openings 50 are also provided on the securement plate 38. As shown by FIG. 11, the through openings 50 function to allow a security seal 52 (of the type used by customs in various countries, similar to a zip tie), to be inserted through a through opening 50. The seal 52 is also looped through a ring 54 (such as an O-ring or a D-ring) on the cargo container. This results in securement of the cargo cover 14 with respect to the container. If the cover is opened, the security seal 52 must be cut, evidencing potential tampering.

The securement plate 38 is generally provided with two through openings 50, such that plate 38 the symmetrical. It is generally desirable to be able to use the same plate 38 on either the left or right hand side of the cargo container. Whichever through opening 50 faces upward is the opening that receives the security seal 52.

Figure 12:
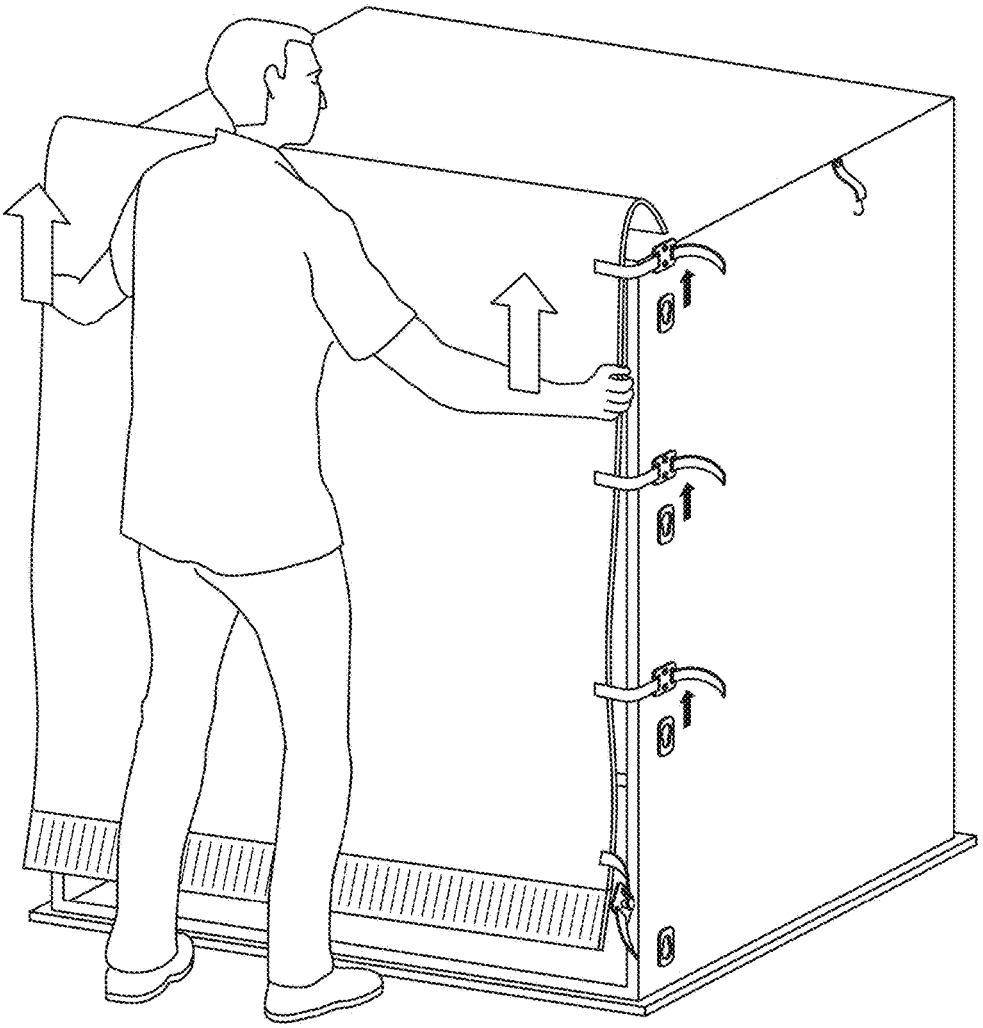
FIG. 12 shows a user opening a cargo container closure system using a single upward motion once the lower securement plate has been released from the frame securement feature.
Figure 13:
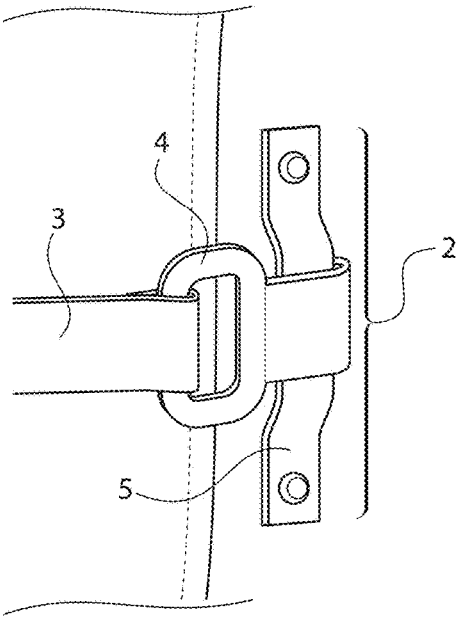
FIG. 13 (Prior Art)
FIG. 13 shows a side perspective view of one example of a prior art cargo closure system.
Figure 14:
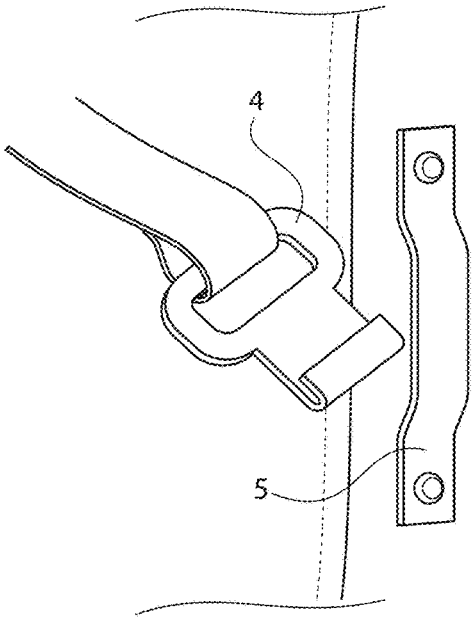
FIG. 14 (Prior Art)
FIG. 14 shows a side perspective view of the hook and bracket prior art system of FIG. 13.

In order to open the cargo door 14, any security seal 52 that may be in place is removed. The user then un-tensions the can buckles 70. The lowermost securement plate 38*d* is pulled down to release the head 36 from the head-receiving portion 34. The remainder of the securement plates 38*a-c* can be removed from the frame securement portions 30*a-c* by a single upward pull on the door, which causes the remaining securement heads 36 to be released in a single upward movement. This is illustrated by FIG. 12.

Once the cargo door cover 14 is opened, it may be positioned on top of the ceiling 26 in order to load and unload the cargo container 12. The cargo container 12 may feature a hook 74 (or a hook on a strap) positioned midway along the outer ceiling. In use, the hook 74 can be secured through one of the through holes 50 pf the securement plate 38 in order to maintain the cover in place (e.g., in windy or turbulent conditions).

One embodiment provides a cargo door cover 14 having a lower portion 80 incorporating a composite sheet 84. The composite sheet 84 may replace the traditional aluminum panels that have been secured to lower portions of cargo door covers. (Aluminum panels can provide more strength at the base of the cargo door cover in order to create a tighter closure and to prevent escape of small items from the cargo container in transit.) However, when the cargo door cover 14 is opened and thrown on top of the cargo container ceiling 26, the aluminum panels can cause damage to the top of the container. The aluminum panels can also cause injury if the wind blows the cover, causing the aluminum panel to strike someone nearby. By replacing the aluminum panel with a composite sheet 84, such damage and/or injury can be lessened or eliminated altogether. The cargo door cover 14 meet be formed with a pocket, and the composite sheet 84 may be sewn or otherwise secured with respect to the pocket. In another example, the composite sheet 84 may be adhered directly to the cargo door cover 14. In either example, it is also possible to provide a layer of softer material around the composite sheet 84.

Providing a composite sheet 84 can avoid the need for separate attachment of the door cover 14 to the base (such as straps with studs, which may otherwise be used for secure closure). The extra rigidity or stiffness added to the cargo container door 14 by the composite sheet 84 can create sufficiently tight closure of the cargo container door to the base in order to ensure loss of small items is avoided. When the cam buckles 70 are tensioned, this causes the stiff composite sheet 84 to be securely restrained against the front portion of the side walls 22 of the cargo container 12.

Changes and modifications, additions and deletions may be made to the structures and methods recited above and shown in the drawings without departing from the scope or spirit of the disclosure or the following claims.

What is claimed is:

1. A cargo container closure system, comprising:

a cargo cover for closing an opening of a cargo container, the cargo cover comprising a plurality of securement plates secured thereto, each securement plate comprising a head and a stem;

a plurality of frame securement features secured to the cargo container, wherein the number of frame securement features corresponds to the number of securement plates, each frame securement feature comprising a head-receiving portion for receiving the head and an elongated portion for receiving the stem, wherein the frame securement feature comprises a D-slot.

2. The system of claim 1, wherein at least one frame securement feature has a first orientation and at least a second frame securement feature has a second orientation.

3. The system of claim 2, wherein upper frame securement features are positioned in the first orientation and a lowermost frame securement feature is positioned in the second orientation.

4. The system of claim 1, wherein the frame securement features are installed on the cargo cover at an angle.

5. The system of claim 1, wherein each securement plate is secured to a strap positioning the securement plate on the cargo cover.

6. The system of claim 1, wherein each securement plate comprises a release handle for removing the securement plate with respect to each frame securement feature.

7. The system of claim 1, further comprising a plurality of cargo door straps secured to the cargo cover, the plurality of cargo door straps comprising the plurality of securement plates.

8. The system of claim 1, further comprising a cargo door strap secured to each securement plate, wherein the cargo door strap comprises a sizing feature.

9. The system of claim 1, wherein the head-receiving portion and the elongated portion of the frame securement feature are angled with respect to one another.

10. The system of claim 1, wherein the head of the securement plate comprises a circular dimension.

11. The system of claim 1, wherein the cargo door cover comprises a composite sheet at its lower portion.

12. A cargo container closure system, comprising:

a cargo cover for closing an opening of a cargo container, the cargo cover comprising a plurality of securement plates secured thereto, each securement plate comprising a head and a stem;

a plurality of frame securement features secured to the cargo container, wherein the number of frame securement features corresponds to the number of securement plates, each frame securement feature comprising a head-receiving portion for receiving the head and an elongated portion for receiving the stem, wherein each securement plate comprises at least one through hole for receiving a security seal.

13. The system of claim 12, wherein at least one frame securement feature has a first orientation and at least a second frame securement feature has a second orientation.

14. The system of claim 13, wherein upper frame securement features are positioned in the first orientation and a lowermost frame securement feature is positioned in the second orientation.

15. The system of claim 12, wherein the frame securement features are installed on the cargo cover at an angle.

16. The system of claim 12, wherein each securement plate is secured to a strap positioning the securement plate on the cargo cover.

17. The system of claim 12, wherein each securement plate comprises a release handle for removing the securement plate with respect to each frame securement feature.

18. The system of claim 12, wherein each securement plate comprises symmetrical through holes at opposite edges of the securement plate.

19. The system of claim 12, further comprising a plurality of cargo door straps secured to the cargo cover, the plurality of cargo door straps comprising the plurality of securement plates.

20. The system of claim 12, further comprising a cargo door strap secured to each securement plate, wherein the cargo door strap comprises a sizing feature.

21. The system of claim 12, wherein the head-receiving portion and the elongated portion of the frame securement feature are angled with respect to one another.

22. The system of claim 12, wherein the head of the securement plate comprises a circular dimension.

23. The system of claim 12, wherein the cargo door cover comprises a composite sheet at its lower portion.

24. A cargo container closure system, comprising:

a cargo cover for closing an opening of a cargo container, the cargo cover comprising a plurality of securement plates secured thereto, each securement plate comprising a head; a stem; two strap attachment openings configured to be secured to a door strap of the cargo cover and a release handle; and at least one through hole;

a plurality of frame securement features secured to the cargo container, wherein the number of frame securement features corresponds to the number of securement plates, each frame securement feature comprising a head-receiving portion for receiving the head and an elongated portion for receiving the stem, wherein at least one frame securement feature has a first orientation and at least a second frame securement feature has a second orientation.

25. The system of claim 24, wherein upper frame securement features are positioned in the first orientation and a lowermost frame securement feature is positioned in the second orientation.

26. The system of claim 24, wherein the cargo cover comprises a composite sheet at its lower portion.

* * * * *